US006964097B2

(12) United States Patent
Franzini et al.

(10) Patent No.: US 6,964,097 B2
(45) Date of Patent: Nov. 15, 2005

(54) SHAVING APPARATUS

(75) Inventors: John Franzini, Hollis, NH (US); David Roche, Nashua, NH (US); Andrew Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/728,046

(22) Filed: Dec. 4, 2003

(65) Prior Publication Data

US 2005/0120561 A1 Jun. 9, 2005

(51) Int. Cl.[7] ..... B26B 21/44; B26B 21/52
(52) U.S. Cl. ..... 30/41; 30/541
(58) Field of Search ..... 30/41, 538, 541

(56) References Cited

U.S. PATENT DOCUMENTS

| | | | | |
|---|---|---|---|---|
| 1,899,841 A | | 2/1933 | Acken | 30/41 |
| 3,053,422 A | | 9/1962 | Tenison | 222/399 |
| 3,703,765 A | | 11/1972 | Perez | 30/41 |
| 3,726,009 A | | 4/1973 | Hackmyer | 30/41 |
| 4,023,269 A | | 5/1977 | Lopez, Jr. | 30/41 |
| 4,077,119 A | | 3/1978 | Sellera | 30/41 |
| 4,177,556 A | | 12/1979 | Galli, Jr. | 30/41 |
| 4,377,034 A | | 3/1983 | Druash et al. | 30/41 |
| 4,433,483 A | | 2/1984 | Lazarus | 30/41 |
| 4,562,643 A | | 1/1986 | Cataudella | 30/41 |
| 4,635,361 A | * | 1/1987 | DeMars | 30/41 |
| 4,753,006 A | | 6/1988 | Howe | 30/41 |
| 4,760,642 A | | 8/1988 | Kwak | 30/123 |
| 4,791,723 A | | 12/1988 | Jacobson | 30/41 |
| 4,809,432 A | | 3/1989 | Schauble | 30/41 |
| 4,813,138 A | | 3/1989 | Chen | 30/41 |
| 4,868,982 A | | 9/1989 | McComas | 30/41 |
| 4,888,868 A | | 12/1989 | Pritchard | 30/41 |
| 4,908,945 A | | 3/1990 | Jacobson | 30/41 |
| 4,974,319 A | | 12/1990 | Maguire, Jr. et al. | 30/41 |
| 5,014,427 A | | 5/1991 | Byrne | 30/41 |
| 5,016,351 A | | 5/1991 | Drahus | 30/41 |
| 5,092,041 A | | 3/1992 | Podolsky | 30/41 |
| 5,103,560 A | | 4/1992 | Podolsky | 30/41 |
| 5,168,628 A | | 12/1992 | Mock et al. | 30/41 |
| 5,234,140 A | | 8/1993 | Demarest et al. | 222/394 |
| 5,564,190 A | | 10/1996 | Fleetwood | 30/41 |
| 5,673,485 A | | 10/1997 | Hill | 30/41.5 |
| 5,701,674 A | | 12/1997 | Mitchell | 30/41 |
| 5,761,813 A | | 6/1998 | Frick et al. | 30/41 |
| 5,855,066 A | | 1/1999 | Manger | 30/41 |
| 5,983,500 A | | 11/1999 | da Silva | 30/41 |

FOREIGN PATENT DOCUMENTS

| | | |
|---|---|---|
| GB | 2 246 314 A | 1/1992 |
| JP | 10-165668 | 6/1998 |
| JP | 2003210874 | 7/2003 |
| WO | WO 00 / 10780 | 3/2000 |
| WO | WO 00 / 47374 | 8/2000 |
| WO | WO 02 / 32253 A1 | 4/2002 |

OTHER PUBLICATIONS

PCT Search Report for Ser. No. PCT/IB03/01144 dated Oct. 29, 2003.

* cited by examiner

*Primary Examiner*—Douglas D Watts
(74) *Attorney, Agent, or Firm*—Michaud-Duffy Group LLP

(57) ABSTRACT

The present invention is a shaving apparatus that includes a razor cartridge having one or more razor blades, a housing, a flexible bladder, and a handle having an interior cavity and an actuator. The housing includes an exterior surface that is adjacent the razor cartridge and includes one or more ports. The housing is attached to an open end of the flexible bladder such that the one or more ports are in fluid communication with the contents of the flexible bladder. The flexible bladder stores a flowable shaving aid material and is disposed within an interior cavity in the handle. The actuator is operable to collapse the flexible bladder, thereby forcing the flowable shaving aid material from the flexible bladder to the one or more ports. Once the flowable shaving aid material exits the ports, it is dispensed on the surface being shaved adjacent the razor cartridge.

26 Claims, 2 Drawing Sheets

SHAVING APPARATUS

BACKGROUND OF THE INVENTION

1. Technical Field

The present invention relates to shaving apparatus in general, and to shaving apparatus having a mechanism for providing a flowable shaving aid material in particular.

2. Background Information

Numerous attempts have been made to combine a razor assembly with a mechanism for dispensing shaving aid material. Some prior art devices (e.g., U.S. Pat. Nos. 3,726,009 and 1,899,841) disclose a reservoir disposed in the handle of the device for storing shaving aid material. The shaving aid material is propelled from the reservoir to the head of the device through one or more passages extending therebetween. A problem with providing a reservoir within the handle is that it is often necessary to make the handle uncomfortably large to accommodate a desirable amount of shaving aid material. If the handle is kept to a reasonable size, the volume of shaving aid material provided is undesirably small. Another problem with a shaving device having a reservoir containing a liquid or gel material is leakage.

Therefore, it is desirable to provide a shaving apparatus that overcomes these known shortcomings in the prior art.

DISCLOSURE OF THE INVENTION

According to the present invention, a shaving apparatus is provided that includes a razor cartridge, a housing, a handle, and a flexible bladder. The razor cartridge includes one or more razor blades and is mounted on the handle and/or the housing. The housing includes an exterior surface that is adjacent the razor cartridge. In some embodiments the exterior surface may substantially surround the razor cartridge. The exterior surface includes one or more ports. The one or more ports disposed in the exterior surface are in fluid communication with the contents of the flexible bladder. The flexible bladder is operable to store a flowable shaving aid material and at least a portion of the flexible bladder is disposed within an interior cavity in the handle. The handle includes a grip portion and an actuator. The actuator is operable to collapse the flexible bladder, thereby forcing flowable shaving aid material from the flexible bladder to the one or more ports.

According to another aspect of the present invention, a replacement cartridge includes the housing, razor cartridge, and flexible bladder described above. The replacement cartridge is sized and shaped such that it can be removably mounted to the handle described.

According to a further aspect of the present invention, a shaving apparatus includes the replacement cartridge mounted to the handle described above.

An advantage of the present invention shaving apparatus is that it does not require an uncomfortably large handle.

Another advantage of the present invention is that the flowable shaving aid does not leak from the flexible bladder.

These and other objects, features, and advantages of the present invention will become apparent in light of the detailed description of the present invention.

DETAILED DESCRIPTION OF THE INVENTION

Figure 1:
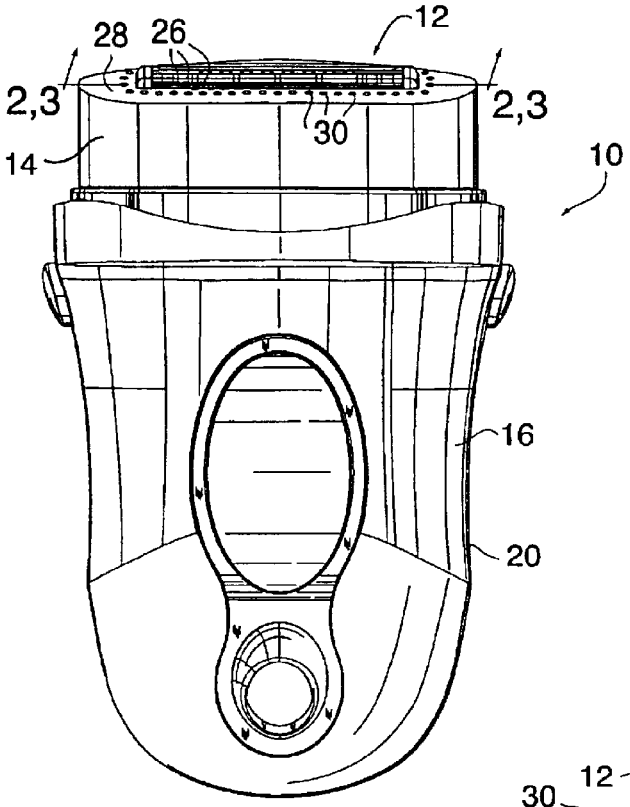
FIG. 1 is a diagrammatic front view of a shaving apparatus of the present invention.
Figure 2:
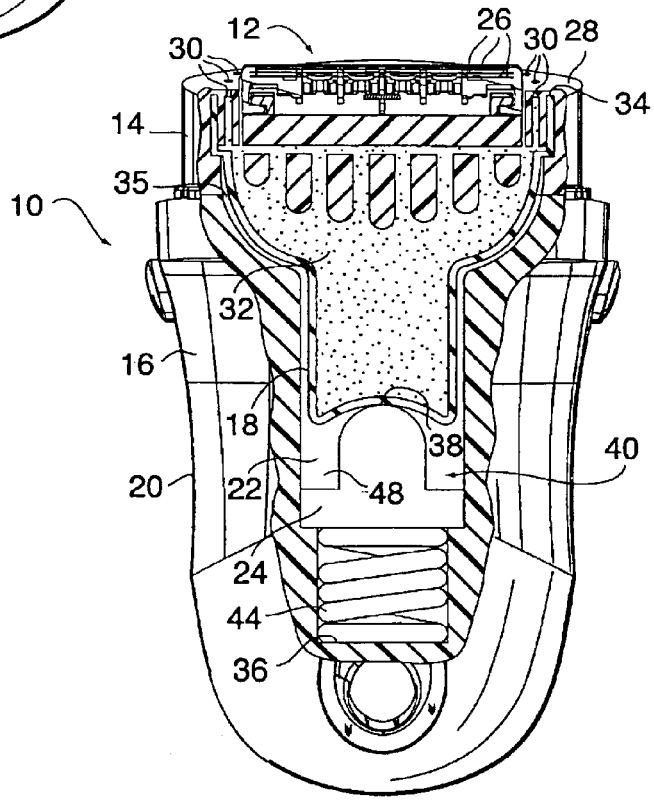
FIG. 2 is sectional view of FIG. 1 across line 2—2 depicting a substantially filled flexible bladder and an actuator having a curved contact surface in a first position.

Referring to FIGS. 1 and 2, a shaving apparatus 10 includes a razor cartridge 12, a housing 14, a handle 16, and a flexible bladder 18 (see FIG. 2). The handle 16 includes an exterior grip portion 20, an interior cavity 22 and an actuator 24.

The razor cartridge 12 includes one or more razor blades 26 and is pivotally or fixedly attached to the housing 14 and/or the handle 16. A variety of different razor cartridges 12 can be used with the present shaving apparatus 10, including those that are intended to be disposable. Therefore, in some embodiments, various different replacement razor cartridges 12 may be used with the same handle 16 and/or housing 14. The present apparatus is not, therefore, limited to any particular type of razor cartridge 12.

Figure 3:
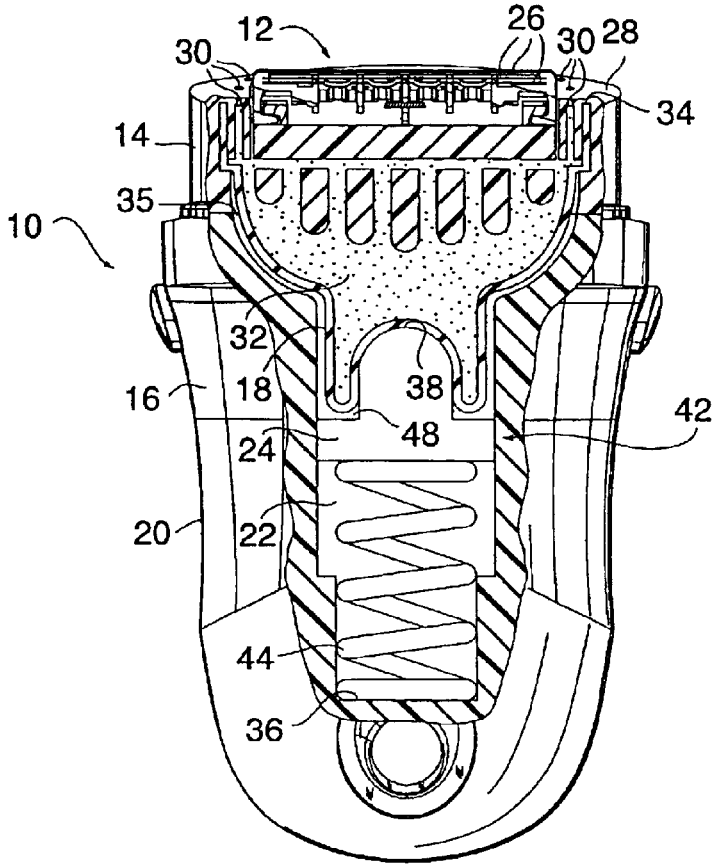
FIG. 3 is sectional view of FIG. 1 across line 3—3 depicting an actuator in between the first position and a second position pressing against a partially filled flexible bladder.

Referring to FIGS. 1–3, the housing 14 includes an exterior surface 28 and one or more ports 30 (see FIG. 1). The exterior surface is adjacent, or substantially surrounds, the razor cartridge 12. The exterior surface 28 may be smooth or textured. The exterior surface 28 includes one or more ports 30 that are adjacent the razor cartridge 12. The one or more ports 30 may be positioned such that they are fore and/or aft the razor cartridge 12 during normal shaving. Typically, the positioning of the one or more ports 30 depends on the type of flowable shaving aid material 32 (discussed infra.) disposed within the flexible bladder 18. The housing 14 is attached to an open end 34 of the flexible bladder 18 such that the one or more ports 30 are in fluid communication with the contents of the flexible bladder 18. The one or more ports 30 are sized to allow the contents of the flexible bladder 18 to pass therethrough. The size of the one or more ports 30 can be varied to accommodate the type of flowable shaving aid material 32 used and the rate at which it is desired that the flowable shaving aid material 32 be dispensed from the shaving apparatus 10.

The flexible bladder 18 is operable to store a flowable shaving aid material 32 and is disposed within the interior cavity 22 in the handle 16. The flexible bladder 18 may be made of any suitable flexible material that can be substantially collapsed. Preferably, the flexible bladder 18 has a shape (as shown in FIG. 2), when substantially filled with flowable shaving aid material 32, that is complimentary to the shape of the interior cavity 22 in the handle 16. As mentioned, the open end 34 of the flexible bladder 18 is attached to the housing 14 such that the flowable shaving aid material 32 contained therein is in fluid communication with the one or more ports 30. In some embodiments the flexible bladder 18 is removably attached to the housing 14.

As mentioned, the flexible bladder is operable to store a flowable shaving aid material 32; e.g., a liquid, cream, gel, etc. Flowable shaving aid materials 32 include, but are not limited to, lubricating agents, drag reducing agents, depilatory agents, cleaning agents, medicinal agents, and the like, that enhance the shaving process.

Referring to FIGS. 2 and 3, the handle 16 includes an exterior grip portion 20, an interior cavity 22 and an actuator 24. The exterior grip portion 20 is typically ergonomically shaped in order to facilitate gripping the handle 16. The interior cavity 22 includes an open end 35 and a base 36. The interior cavity is sized and shaped to receive the flexible bladder 18. The handle 16 is attached to the housing 14. In some embodiments, the handle 16 is not intended to be detached from the housing 14 during normal use. In other embodiments, the handle 16 is removably attached to the housing 14.

The actuator 24 includes a contact surface 38 and is operable to move between a first position 40 (as shown in FIG. 2) and second position 42 (as shown in FIG. 3). The actuator 24 is positioned in the interior cavity 22 such that the flexible bladder 18, when inserted in the interior cavity 22, is substantially in between the actuator 24 and the one or more ports 30 of the housing 14. In the first position 40, the actuator 24 is located within the handle so that a substantially filled flexible bladder 18 may be disposed within the interior cavity. In the second position 42, the actuator 24 is located within the handle at a position within the interior cavity that is initially occupied by the substantially filled flexible bladder 18. As can be seen in FIG. 3, in some embodiments a detent mechanism 43 is provided that selectively secures the actuator 24 at one or more second positions. The detent mechanism 43 is a mechanical arrangement (e.g., buttons, tabs, etc.) that is operable to maintain the actuator at the one or more second positions; i.e., to prevent the actuator 24 from moving toward the ports 30 (e.g., collapsing the flexible bladder 18) or away from the ports 30 (e.g., allowing the flexible bladder to expand), or both.

Referring to FIGS. 2 and 3, in some embodiments the contact surface 38 of the actuator 24 is curved. The curved surface creates peripheral space 48 to accommodate flexible bladder material as the flexible bladder 18 collapses. The curved contact surface 38 also advantageously decreases the amount of folding or creasing of the flexible bladder 18. Therefore, the curved surface effectively prevents substantial amounts of flowable shaving aid material 32 from becoming trapped and wasted.

Continuing to refer to FIGS. 2 and 3, in some embodiments, a biasing mechanism 74 causes the actuator 24 to move between the first position 40 and the second position 42. An example of an acceptable biasing member is the coil spring 44 shown in FIGS. 2 and 3. The coil spring is operable to apply pressure against the actuator. In turn, the contact surface 38 of the actuator 24 presses against the flexible bladder 18. As a result, the actuator 24 moves toward the second position 42, forcing flowable shaving aid material 32 from the flexible bladder 18 as it collapses the bladder 18. Preferably, the flexible bladder 18 is substantially collapsed, or empty, when the actuator 24 is in the second position 42.

In some embodiments, the actuator 24 moves freely between the first and second positions 40,42. In other embodiments, the handle 16 includes a latch to control the position of the biasing mechanism 44. The latch enables the actuator 24 to be stopped and held at one or more intermediate positions between the first position 40 and the second position 42 to facilitate metering the amount of flowable shaving aid material 32 forced from the flexible bladder 18. Although the Detailed Description describes the biasing mechanism 44 in terms of a spring, numerous other types of biasing mechanisms 44 capable of propelling the actuator at least partially from the first position 40 to the second position 42 can be used, alternatively.

Figure 4:
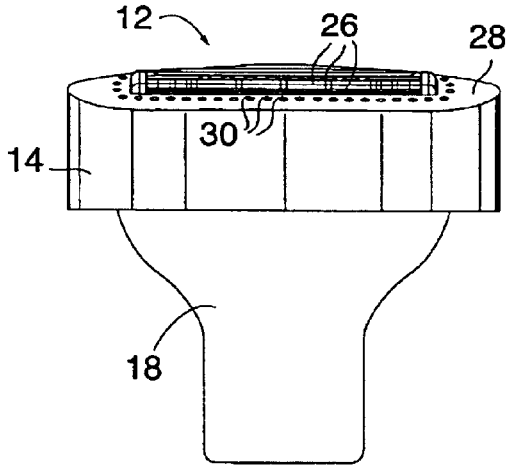
FIG. 4 is a diagrammatic view of a replacement cartridge of the present invention.

Referring to FIG. 4, and according to another aspect of the invention, the razor cartridge 12, housing 14 and flexible bladder 18 described above can be combined to form a replacement cartridge 50. The replacement cartridge 50 is removably mounted to the handle 16 in a manner such that the flexible bladder 18 is inserted into the interior cavity 22 of the handle 16. Typically, the replacement cartridge 50 is used until the contents of the flexible bladder 18 have been substantially emptied. Once emptied, the replacement cartridge 50 is selectively removed from the handle 16 and replaced with another replacement cartridge 50.

In operation of the present invention, the user causes the actuator 24 to move at least partially toward the second position 42. The actuator 24 causes the volume of the flexible bladder 18 to decrease. As a result, flowable shaving aid material 32 is forced from the flexible bladder 18 and to the one or more of the ports 30 in the exterior surface 28 of the housing 14. The user then brings the shaving apparatus 10 in contact with the surface being shaved where the flowable shaving aid material 32 is dispensed onto the user adjacent the razor cartridge 12. As the user moves the shaving apparatus 10 along the surface being shaved, the flowable shaving aid material 32 is dispensed from the one or more ports 30 and on to the surface being shaved. Simultaneously, the razor cartridge 12 shaves hair from the surface.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A shaving apparatus, comprising:

a razor cartridge having one or more razor blades;

a handle having an interior cavity;

a flexible bladder operable to store shaving aid material, the flexible bladder being disposed within the interior cavity of the handle;

a housing having an exterior surface, the exterior surface including one or more ports disposed adjacent the razor cartridge, the one or more ports being in fluid communication with the bladder; and an actuator operable to decrease the volume of the bladder, thereby forcing the shaving aid material from the flexible bladder to the one or more ports, the actuator being movable between a first position and a second position;

wherein the handle further includes a biasing mechanism operable to bias the actuator toward the second position.

2. The shaving apparatus of claim 1 wherein the razor cartridge is mounted on the handle.

3. The shaving apparatus of claim 2, wherein the razor cartridge is removably mounted on the handle.

4. The shaving apparatus of claim 1 wherein the razor cartridge is mounted on the housing.

5. The shaving apparatus of claim 4, wherein the razor cartridge is removably mounted on the housing.

6. The shaving apparatus of claim 1, wherein the one or more ports are adjacent the razor cartridge.

7. The shaving apparatus of claim 1, wherein the housing substantially surrounds the razor cartridge.

8. The shaving apparatus of claim 1, wherein the flowable shaving aid material is disposed within the flexible bladder.

9. The shaving apparatus of claim 8, wherein the flexible bladder is shaped complimentarily to the interior cavity of the handle when substantially filled with flowable shaving aid material.

10. The shaving apparatus of claim 1, further comprising a detent mechanism for selectively securing the actuator.

11. The shaving apparatus of claim 1, wherein in the first position the actuator is located within the interior cavity such that a substantially filled flexible bladder may be disposed within the interior cavity.

12. The shaving apparatus of claim 1, wherein in the second position the actuator is located within the interior cavity at a position that is initially occupied by the substantially filled flexible bladder.

13. The shaving apparatus of claim 1, wherein the biasing mechanism includes at least one spring.

14. The shaving apparatus of claim 1, wherein the actuator includes a curved contact surface.

15. A shaving apparatus, comprising:

a handle having an interior cavity and an actuator;

a replacement cartridge including a flexible bladder operable to store a flowable shaving aid material, and a housing having an exterior surface including one or more ports, the one or more ports being in fluid communication with the contents of the flexible bladder;

wherein the replacement cartridge is selectively mounted to the handle such that the flexible bladder is at least partially inserted into the interior cavity of the handle; and wherein the actuator is operable to collapse the bladder, and thereby force shaving aid material from the bladder to the one or more ports, the actuator being movable between a first position and a second position;

wherein the handle further includes a biasing mechanism operable to bias the actuator toward the second position.

16. The shaving apparatus of claim 15 further including a razor cartridge mounted adjacent the one or more ports.

17. The shaving apparatus of claim 16, wherein the housing substantially surrounds the razor cartridge.

18. The shaving apparatus of claim 15, wherein the flowable shaving aid material is disposed within the flexible bladder.

19. The shaving apparatus of claim 18, wherein the flexible bladder is shaped complimentarily to the interior cavity of the handle when substantially filled.

20. The shaving apparatus of claim 15, wherein in the first position the actuator is located within the interior cavity such that a substantially filled flexible bladder may be disposed within the interior cavity.

21. The shaving apparatus of claim 15, wherein in the second position the actuator is located within the interior cavity at a position that is initially occupied by the substantially filled flexible bladder.

22. The shaving apparatus of claim 15, wherein the biasing mechanism includes at least one spring.

23. The shaving apparatus of claim 15, wherein the actuator includes a curved contact surface.

24. A replacement cartridge for a shaving apparatus, comprising:

a flexible bladder operable to store a flowable shaving aid material;

a housing having an exterior surface, the exterior surface including one or more ports, the one or more ports being in fluid communication with the bladder; and a razor cartridge having one or more razor blades, the razor cartridge being mounted adjacent the one or more ports.

25. The replacement cartridge of claim 24, wherein the housing substantially surrounds the razor cartridge.

26. The replacement cartridge of claim 24, wherein the flowable shaving aid material is disposed within the flexible bladder.

* * * * *